United States Patent [19]

Curtis et al.

[11] Patent Number: 4,905,638

[45] Date of Patent: Mar. 6, 1990

[54] TWO STAGE CARBURETOR

[75] Inventors: Mark D. Curtis, Oshkosh; James L. Wagner, Neenah, both of Wis.

[73] Assignee: Brunswick Corporation, Skokie, Ill.

[21] Appl. No.: 295,481

[22] Filed: Mar. 10, 1989

[51] Int. Cl.[4] ..... F02B 75/02

[52] U.S. Cl. ..... 123/73 A; 123/73 V

[58] Field of Search ..... 123/73 A, 73 C, 73 V

[56] References Cited

U.S. PATENT DOCUMENTS

| | | | |
|---|---|---|---|
| 2,481,901 | 9/1949 | Bracke | 123/73 V |
| 2,639,699 | 5/1953 | Kiekhaeffer | 123/73 V |
| 3,166,054 | 1/1965 | Conover | 123/73 V |
| 3,859,968 | 1/1975 | Stinebaugh | 123/73 V |
| 4,228,770 | 10/1980 | Boyesen | 123/73 V |
| 4,248,185 | 2/1981 | Jaulmes | 123/73 A |
| 4,696,263 | 9/1987 | Boyesen | 123/73 V |
| 4,770,132 | 9/1988 | Sougawa | 123/73 A |

*Primary Examiner*—David A. Okonsky

*Attorney, Agent, or Firm*—Andrus, Sceales, Starke & Sawall

[57] ABSTRACT

A two stage carburetor for introduction of an air-fuel mixture into the crankcase of a two-stroke marine engine includes a carburetor body that defines a pair of throttle bores, one of which has a reduced cross-sectional area. The throttle bores deliver an air-fuel mixture to separate and distinct reed blocks having comparable cross-sectional areas.

8 Claims, 5 Drawing Sheets

FIG. 4A
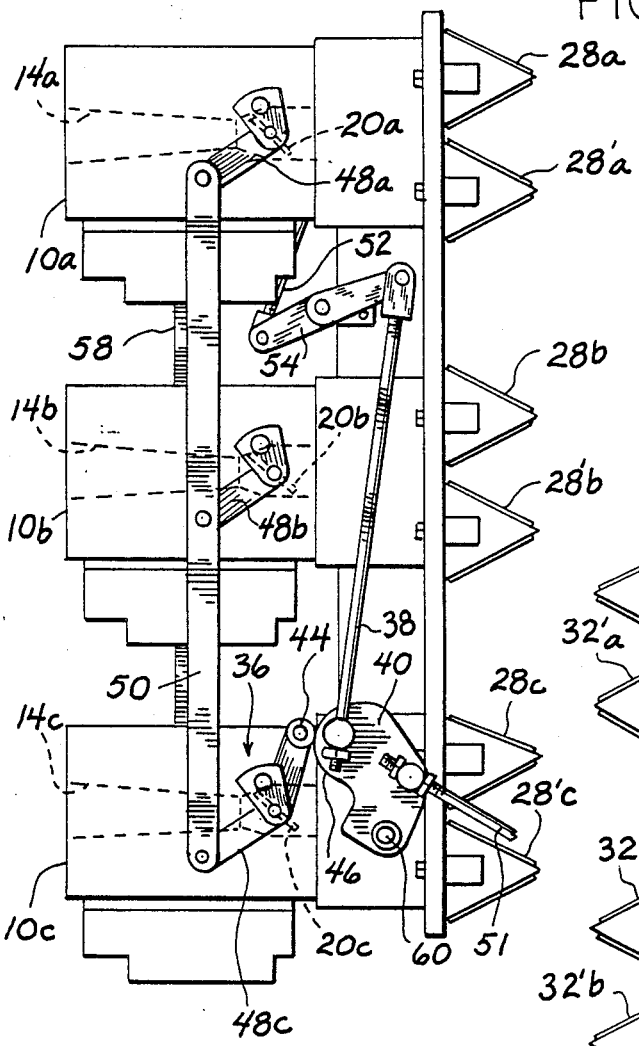
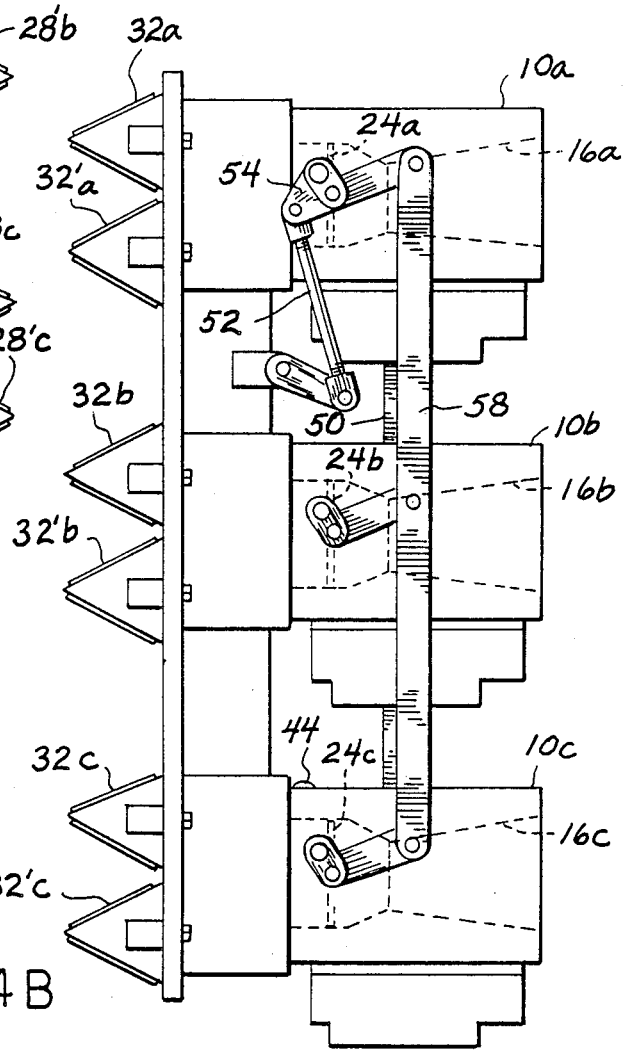
FIG. 4B

FIG. 5A
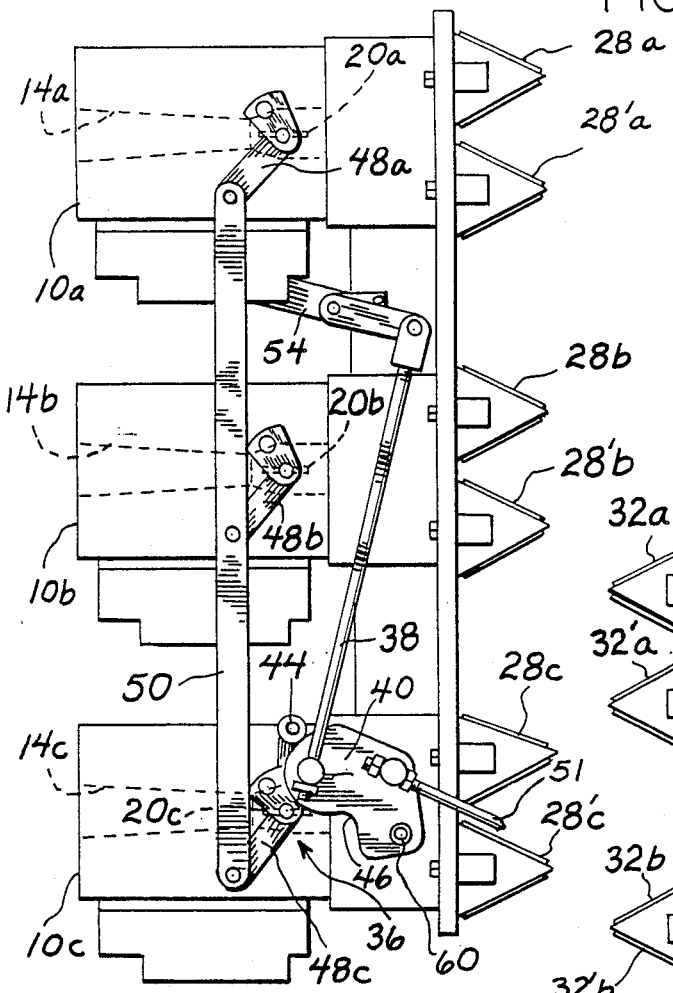
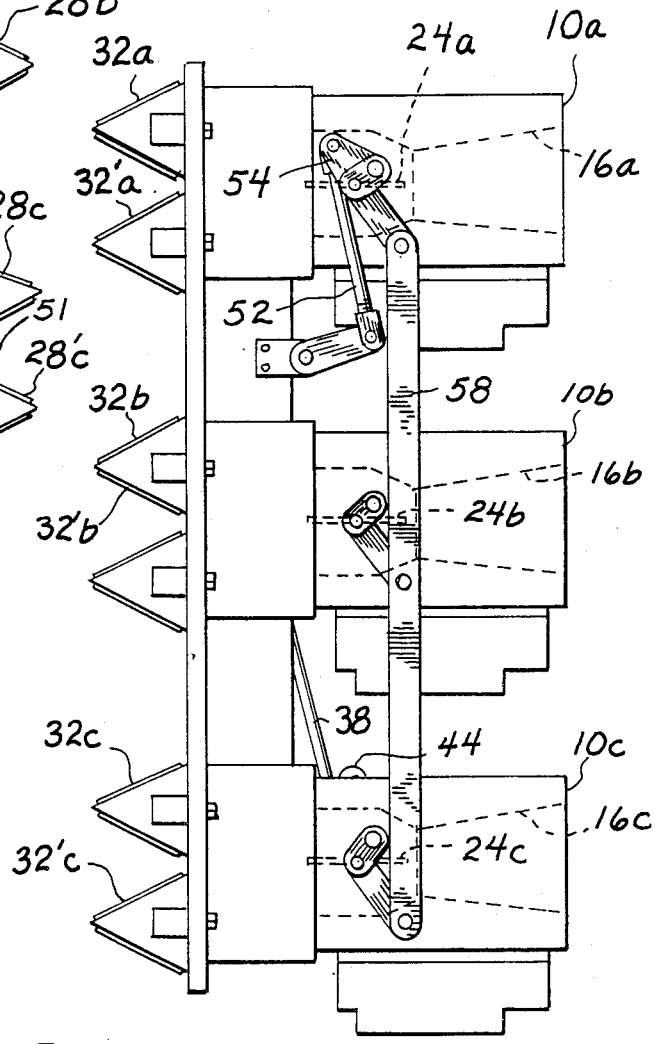
FIG. 5B

TWO STAGE CARBURETOR

BACKGROUND OF THE INVENTION

The present invention relates to a for a marine engine and more particularly to a stage carburetor for introduction of an air-fuel mixture into the crankcase of a two stroke marine engine.

Prior art marine engine carburetors utilize a single bore or throat with a pivoting throttle plate for delivering an air-fuel mixture to a reed block for introduction of the mixture into the crankcase of a two stroke marine engine. The cross-sectional area of the throttle bore had to be of a size sufficient to provide an adequate air-fuel mixture during a wide open throttle operation of the engine. However, the rather large throttle bore resulted in poor fuel economy at low R.P.M.'s or idle operation of the engine and also caused poor operation quality at idle and low R.P.M. The large throttle bore also caused fuel puddling during operation at idle speeds due to the low velocity of the air-fuel mixture and resulting poor atomization of the fuel.

It is an object of the present invention to provide a two stage carburetor which will have a primary throttle bore that introduces an air-fuel mixture into the crankcase at low engine R.P.M.'s or during idle operation and a secondary throttle bore that becomes operable at higher R.P.M. engine operation.

Such a two stage carburetor ensures a high velocity of the air-fuel mixture through the reed blocks regardless of the throttle setting of the engine.

It is a further object of the present invention to eliminate fuel puddling and provide better low speed fuel economy and engine running quality for low R.P.M. operation of the engine, while still maintaining high power during wide open throttle operation of the engine.

SUMMARY OF THE INVENTION

A two stage carburetor for introduction of an air-fuel mixture into the crankcase of a two stroke marine engine includes a carburetor body defining a first throttle bore of first cross-sectional area and containing a pivoting throttle plate movable between an open and closed position.

In accordance with another aspect of the invention, the carburetor body also defines a second throttle bore having a cross-sectional area greater than that of the first throttle bore and also containing a pivoting throttle plate movable between an open and closed position.

In accordance with yet another aspect of the invention, each of the throttle bores is provided with a distinct and separate reed block having a cross-sectional area comparable to its respective throttle bore.

In accordance with still another aspect of the invention, the carburetor is provided with a throttle linkage that is operably connected to the throttle plates of the first and second bores and which moves the throttle plate in the first bore to a substantially open position prior to moving the throttle plate in the second bore away from its closed position.

The present invention thus provides a two stage carburetor in which the proper air-fuel mixture is delivered to the cylinder at a high rate of speed regardless of the throttle setting of the engine.

BRIEF DESCRIPTION OF THE DRAWINGS

The drawings illustrate the best mode presently contemplated of carrying out the invention.

In the drawings:

FIG. 4A is a view of the carburetors of FIG. 3A with the primary throttle bores being moved to an open position;

FIG. 4B is a left hand side view of the carburetors of FIG. 4A;

FIG. 5A is a right hand side view of the carburetors of FIG. 3A with the primary throttle bore in a wide open condition;

FIG. 5B is a left hand side view of the carburetors of FIG. 5A with the secondary throttle bores in a wide open condition.

DETAILED DESCRIPTION OF THE PREFERRED EMBODIMENT

Figure 1:
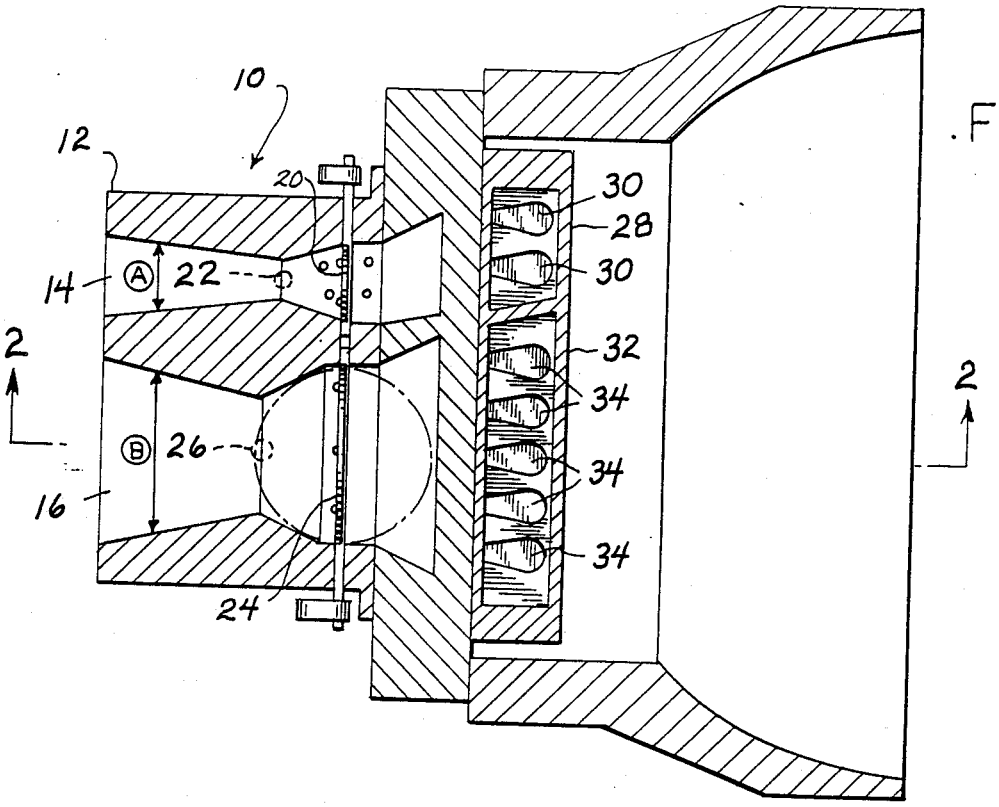
FIG. 1 is a sectional view taken along the line 1—1 of FIG. 3A.
Figure 2:
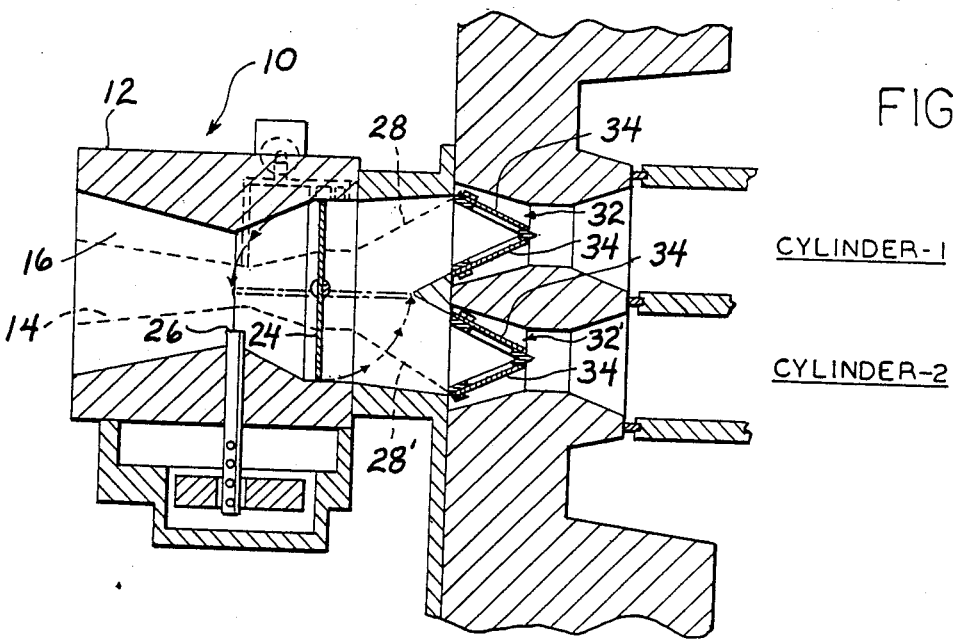
FIG. 2 is a sectional view taken along the line 2—2 of FIG. 1.

As shown in FIGS. 1 and 2 a two stage carburetor 10 is comprised of a carburetor body 12 which defines a primary throttle bore 14 having a cross-sectional area "A" and a substantially adjacent secondary throttle bore 16 having a cross-sectional area "B". Throttle bores 14 and 16 are separated by body wall 18 and cross-sectional area "B" is approximately five times that of cross-sectional area "A".

A throttle plate 20 is pivotally mounted in primary throttle bore 14 and is movable between a closed position in which the flow of an air-fuel mixture through bore 14 is prohibited and an open position in which the flow is permitted. Throttle bore 14 is also provided with a venturi 22 which is located upstream of throttle plate 20 and which introduces fuel into primary throttle bore 14.

Similarly, secondary throttle bore 16 is provided with a throttle plate 24 which also can be pivoted between an open and closed position and a venturi 26 which is located upstream of throttle plate 24 and which introduces fuel into secondary throttle bore 16. The diameter of venturi 26 is greater than that of venturi 22, since it is supplying fuel to a throttle bore of greater area.

The fuel-air mixture passing through primary throttle bore 14 is delivered to a pair of reed blocks 28 and 28' which contain reed valves 30 which open in response to a pressure differential in the crankcase caused by reciprocating movement of a pair of engine cylinders. The opening of reed valves 30 allows the air-fuel mixture to be introduced into the crankcase for a pair of cylinders 1 and 2.

Similarly, the air-fuel mixture passing through secondary throttle bore 16 is delivered to a pair of reed blocks 32 and 32' which contain reed valves 34 which when in their open position introduce the fuel-air mixture into the crankcase for engine cylinders 1 and 2. Thus each of cylinder bores 14 and 16 terminate in a pair of reed blocks that provide the air-fuel mixture for a pair of engine cylinders.

FIGS. 3 through 6 illustrate the use of a series of three two stage carburetors 10*a* through 10*c* stacked in a vertical array and supplying an air-fuel mixture to a six cylinder marine engine. The movement of throttle plates 20 and 24 between their open and closed positions is controlled by a pair of throttle linkages 36 and 38 each of which is operatively connected to pivotable member 40.

Throttle linkage 36 is connected to pivotal member 40 by means of extension 42 that terminates in a roller 44 that rides along camming surface 46 of member 40. Extension 42 is pivotally connected to arm 48*c* which is operatively connected to throttle plate 20*c* so that movement of roller 44 along camming surface 46 results in downward movement of arm 48*c* and movement of throttle plate 20*c* from a closed to an open position. The movement of arm 48*c* is transmitted to arms 48*a* and 48*b* through connecting arm 50 so that throttle plates 20*a* and 20*b* are moved in an identical fashion.

Figure 3A:
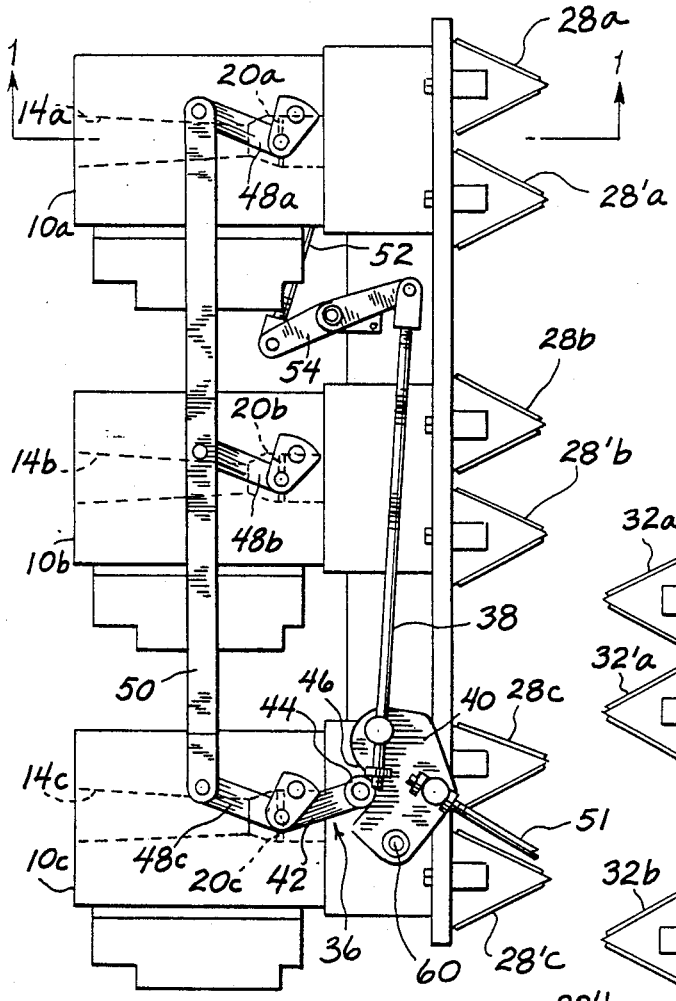
FIG. 3A is a right hand side view of a series of three vertically mounted carburetors constructed according to the present invention.
Figure 3B:
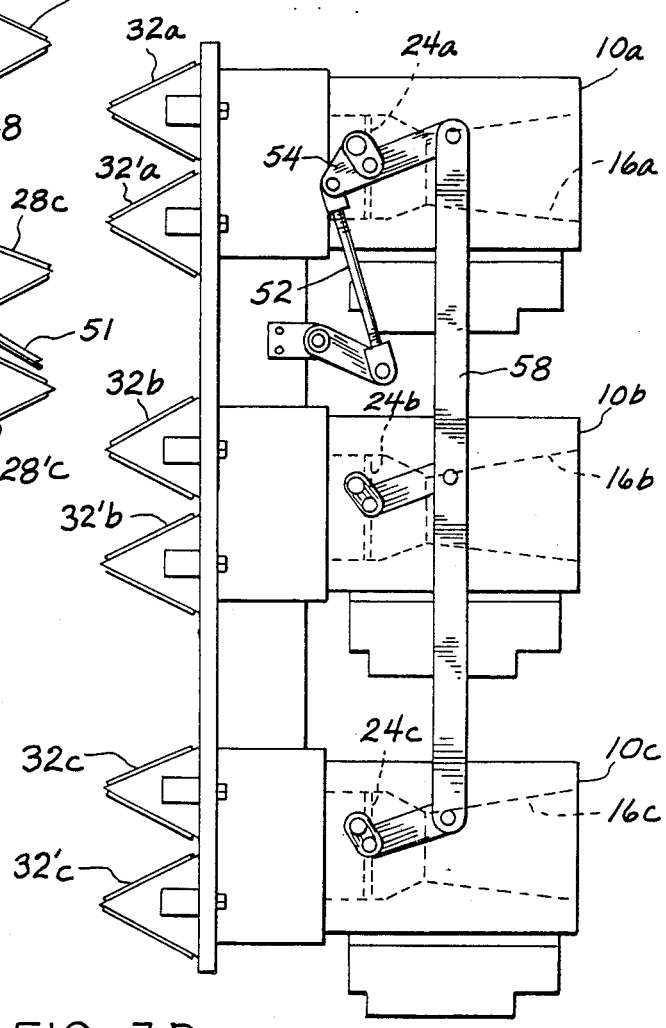
FIG. 3B is a left hand side view of the carburetors of FIG. 3A.
Figure 6:
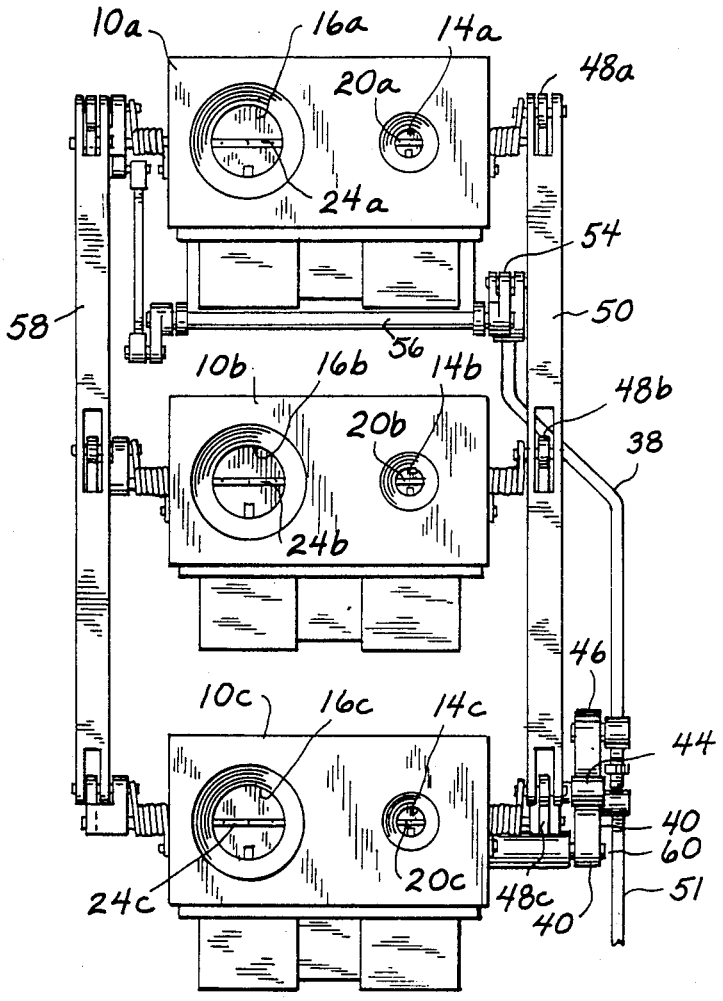
FIG. 6 is a rear view of the carburetors of FIG. 3A.

FIG. 3A shows throttle plates 20*a* through 20*c* in their closed position. In FIG. 4A pivotable member 40 has been rotated by a force exerted by throttle cable 51 and roller 44 is moved along camming surface 46 to a point where throttle plates 20*a* through 20*c* have opened approximately halfway. At this point secondary throttle plates 24*a* through 24*c* remain in their closed position as shown in FIG. 4B.

The movement of secondary throttle plates 24*a* through 24*c* is caused by movement of throttle linkage 38 which is pivotally fastened to an upper portion of pivotal member 40. While the pivotal movement of member 40 from the position shown in FIG. 3A to the position shown in FIG. 3B caused substantial movement of roller 44 along camming surface 46, there was very little, if any, vertical movement of linkage 38. However, as the pivotal movement of member 40 continues to that shown in FIG. 5A, the downward movement of linkage 38 becomes substantial and this downward movement of linkage 38 is translated into upward movement of control arm 52 by means of pivoting arm 54 and cross linkage 56. This substantial movement of linkage 38 occurs subsequent to throttle plates 20*a* moving to a substantially open position.

Thus, the further pivotal movement of member 40 from its position shown in FIG. 4A to that shown in 5A results in substantial downward movement of linkage 38 which is translated into substantial upward movement of control arm 52. Control arm 52 is operably connected to secondary throttle plate 24 through linkage 54 and thus the downward movement of linkage 38 causes secondary throttle plate 24*a* to move from its closed to its open position. The movement of control arm 52 is communicated to secondary throttle plates 24*b* and 24*c* by means of connecting arm 58.

In operation, the operator of the boat moves the throttle control (not shown) which in turn moves throttle cable 51 causing pivotal member 40 to pivot about point 60. As discussed above, the initial pivoting movement of member 40 results in substantial movement of primary throttle plates 20*a* through 20*c*. Thus, primary throttle bores 14*a* through 14*c* will be progressively opened and a small quantity of an air-fuel mixture will be delivered at a high velocity to primary reed blocks 28*a* and 24*b*. Thus, at low engine R.P.M.'s or idle operation the smaller throttle bores are utilized to provide an adequate yet reduced quantity of air-fuel mixture at a high velocity to the engine cylinders. As the operator continues to move the throttle control, pivoting member 40 moves to its position shown in FIG. 5A in which primary throttle bores 14*a* through 14*c* are fully open and secondary throttle bores 16*a* through 16*c* have been opened to deliver a much higher quantity of air-fuel mixture to the engine so that it may be operated at wide open throttle or very high R.P.M.'s.

Various modes of carrying out the invention are contemplated as being within the scope of the following claims, particularly pointing out and distinctly claiming the subject matter which is regarded as the invention.

We claim:

1. A two stage carburetor for introduction of an air-fuel mixture into the crankcase of a two-stroke marine engine comprising:

a carburetor body defining, a first throttle bore of first cross-sectional area and containing a pivoting throttle plate movable between an open position in which an air-fuel mixture is allowed to pass through said first throttle bore and a closed position in which the passage of the air-fuel mixture through said first throttle bore is prohibited, and a second throttle bore of second cross-sectional area greater than said first cross sectional area and containing a pivoting throttle plate movable between an open position in which an air-fuel mixture is allowed to pass through said second throttle bore and a closed position in which the passage of the air-fuel mixture is prohibited, a first reed block disposed downstream from said first throttle bore and having a cross-sectional area substantially equal to said first throttle bore cross-sectional area, said first reed block receiving the air-fuel mixture from said first throttle bore and introducing the mixture into the crankcase of an engine cylinder, a second reed block disposed downstream from said second throttle bore and having a cross-sectional area substantially equal to said second throttle bore cross-sectional area, said second reed block receiving the air-fuel mixture from said second throttle bore and introducing the mixture into the crankcase of said engine cylinder, and throttle plate control means for moving said throttle plates of said first and second throttle bores between said closed and open positions, said control means moving said first bore throttle plate to said open position prior to moving said second bore throttle plate from said closed position.

2. The two stage carburetor defined in claim 1 wherein said second cross-sectional area is at least four times greater than said first cross-sectional area.

3. The two stage carburetor defined in claim 1 further comprising a first venturi for said first throttle bore and a second venturi for said second throttle bore with said second venturi having a cross-sectional area greater than that of said first venturi.

4. The two stage carburetor defined in claim 1 wherein said first throttle bore is disposed substantially adjacent said second throttle bore within said carburetor body.

5. The two stage carburetor defined in claim 1 wherein said throttle plate control means comprises, a first linkage disposed on one side of said carburetor body and operably connected to said throttle plate of said first bore, a second linkage disposed on the opposite side of said carburetor body and operably connected to said throttle plate of said second bore, and connecting means for operably joining said first and second linkages so that movement of said first linkage results in movement of said first throttle bore throttle plate to a substantially open position and subsequent movement of said second linkage.

6. The two stage carburetor defined in claim 1 further comprising a third reed block downstream from said first throttle bore and having a cross-sectional area substantially equal to said first throttle bore cross-sectional area, said third reed block receiving the air-fuel mixture from said first throttle bore and introducing the mixture into the crankcase of a second engine cylinder.

7. The two stage carburetor defined in claim 1 further comprising a fourth reed block downstream from said second throttle bore and having a cross-sectional area substantially equal to said second throttle bore cross-sectional area, said fourth reed block receiving the air-fuel mixture from said second throttle bore and introducing the mixture into the crankcase of a second engine cylinder.

8. A two stage carburetor for introduction of an air-fuel mixture into the crankcase of a two-stroke marine engine comprising:

a carburetor body defining, a first throttle bore of first cross-sectional area and containing a pivoting throttle plate movable between an open position in which an air-fuel mixture is allowed to pass through said first throttle bore and a closed position in which the passage of the air-fuel mixture through said first throttle bore is prohibited, and a second throttle bore of second cross-sectional area greater than said first cross sectional area and containing a pivoting throttle plate movable between an open position in which an air-fuel mixture is allowed to pass through said second throttle bore and a closed position in which the passage of the air-fuel mixture is prohibited, a first reed block disposed downstream from said first throttle bore and having a cross-sectional area substantially equal to said first throttle bore cross-sectional area, said first reed block receiving the air-fuel mixture from said first throttle bore and introducing the mixture into the crankcase of an engine cylinder, a second reed block disposed downstream from said second throttle bore and having a cross-sectional area substantially equal to said second throttle bore cross-sectional area, said second reed block receiving the air-fuel mixture from said second throttle bore and introducing the mixture into the crankcase of said engine cylinder, a third reed block downstream from said first throttle bore and having a cross-sectional area substantially equal to said first throttle bore cross-sectional area, said third reed block receiving the air-fuel mixture from said first throttle bore and introducing the mixture into the crankcase of a second engine cylinder, a fourth reed block downstream from said second throttle bore and having a cross-sectional area substantially equal to said second throttle bore cross-sectional area, said fourth reed block receiving the air-fuel mixture from said second throttle bore and introducing the mixture into the crankcase of a second engine cylinder, a first linkage disposed on one side of said carburetor body and operably connected to said throttle plate of said first bore to move said throttle plate between said closed and open positions, a second linkage disposed on the opposite side of said carburetor body and operably connected to said throttle plate of said second bore to move said throttle plate between said closed and open positions, and connecting means for operably joining said first and second linkages so that movement of said first linkage results in subsequent movement of said second linkage so that said throttle plate of said first throttle bore is moved to said open position prior to moving said second throttle bore plate from said closed position.

* * * * *